US005094635A

United States Patent [19]

Thompson et al.

[11] Patent Number: 5,094,635

[45] Date of Patent: Mar. 10, 1992

[54] UNIVERSAL AUTOMOTIVE ELECTRICAL APPARATUS KIT CONNECTABLE TO AUTOMOBILE BATTERY

[75] Inventors: Stephen S. Thompson, Bel Air; Pradeep M. Bhagwat, Baltimore, both of Md.

[73] Assignee: Black & Decker Inc., Newark, Del.

[21] Appl. No.: 613,321

[22] Filed: Nov. 14, 1990

[51] Int. Cl.[5] ..... H01R 4/30; H01R 4/38

[52] U.S. Cl. ..... 439/755; 307/10.7; 320/2; 439/754; 439/766

[58] Field of Search ..... 439/34, 502-504, 439/506, 754-768, 726-729; 320/2; 307/10.7

[56] References Cited

U.S. PATENT DOCUMENTS

| | | | |
|---|---|---|---|
| 2,479,834 | 8/1949 | Herbert | 439/754 |
| 3,595,701 | 7/1971 | Lewis et al. | 136/135 R |
| 3,605,065 | 9/1971 | Shannon | 339/28 R |
| 4,425,414 | 1/1984 | Solomon | 429/179 |

FOREIGN PATENT DOCUMENTS

| | | |
|---|---|---|
| 2359429 | 6/1975 | Fed. Rep. of Germany . |
| 3532044 | 3/1987 | Fed. Rep. of Germany . |

*Primary Examiner*—Paula A. Bradley

*Attorney, Agent, or Firm*—Dennis A. Dearing; John D. Del Ponti; Charles E. Yocum

[57] ABSTRACT

A kit 11 comprises an electrical apparatus 13, a clamp connector 15, a nut connector 17 and an adaptor post 19. Kit 11 enables electrical apparatus 13 to be selectively connected in an automobile in circuit alternatively with an engine starter circuit 21 and a battery 23 having post terminals 25, 27 (FIG. 1) and with an engine starter circuit 29 and an automobile battery 31 having nut terminals 33, 35 (FIG. 2) by appropriate connection of adaptor post 19. Adaptor post 19 is interchangeable between a location (FIG. 2) in which it is clamped in the clamp connector 15 of apparatus 13 and a location (FIG. 1) in which it is threaded into the nut connector 17 of apparatus 13.

8 Claims, 3 Drawing Sheets

UNIVERSAL AUTOMOTIVE ELECTRICAL APPARATUS KIT CONNECTABLE TO AUTOMOBILE BATTERY

FIELD OF THE INVENTION

This invention relates to an electrical apparatus for electrical connection to an automobile engine starting circuit. More particularly, the invention relates to a kit (which includes the electrical apparatus) and which is interchangeably connectable to an engine starting circuit having a battery with post terminals and to an engine starting circuit having a battery with nut terminals.

BACKGROUND OF THE INVENTION

There is a strong commercial interest in automotive consumer electronics which are installed subsequent to the manufacture of the automobile. For commercial acceptance, such consumer electronics are preferably low in cost, are easy to install by an unskilled consumer or by a semiskilled technician and are potentially retrofittable in a large number of automobiles on the market.

One consumer electronic device which is achieving wide commercial acceptance is an automotive security system. Some security systems include an electronic device which is connected in circuit with the automobile engine starting circuit for disabling the starting of the engine in an alarm condition. This may typically be accomplished by providing an open circuit or by restricting current flow between the automobile battery and engine starter circuit when an alarm condition is detected. One problem that has arisen in designing such an engine disabler is the identification of a simple, low cost means for installation of the disabler in automobiles equipped with a standard batter having post terminals and in automobiles equipped with a standard battery having nut terminals (i.e., having a terminal with a threaded opening for receipt of a screw connector). To make the engine disabler alternatively connectable to both standard battery terminal configurations, two different connector assemblies are required. This increases the cost and complexity of the disabler.

SUMMARY OF THE INVENTION

Accordingly, a primary object of this invention is to provide a simple, low cost, easy to install, retrofittable kit for connection of an electrical apparatus in an automobile in circuit with an engine starter circuit and alternatively with an automobile battery having post terminals and with an automobile battery having nut terminals.

In accordance with the invention, as embodied and described herein, a kit is provided for connection in an automobile in circuit with an engine starter circuit and alternatively with an automobile battery having post terminals and with an automobile battery having nut terminals. The kit comprises an electrical apparatus, a clamp connector and a nut connector. The clamp connector is for electrical connection to a post terminal of the automobile battery and is electrically connected to the electrical apparatus. The nut connector is electrically connected to the electrical apparatus and is for electrical connection to a screw connector which is electrically connected to the automobile starter circuit.

The kit preferably further comprises an adapter post having a clampable segment at one end and a screw segment at a second end. The clampable segment of the adaptor post is clampable in the clamp connector and the screw segment is threadable in the nut of the nut connector.

According to the preferred embodiment of the invention, the kit is connectable in circuit with both standard types of automobile batteries by merely interchanging the adaptor post from a location in which it is clamped in the clamp connector of the electrical apparatus and a location in which it is threaded into the nut of the nut connector of the electrical apparatus.

Additional objects and advantages of the invention will be apparent from the detailed description of the preferred embodiment, the appended claims and the accompanying drawings or may be learned by the practice of the invention.

BRIEF DESCRIPTION OF THE DRAWINGS

The accompanying drawings which are incorporated in, and constitute a part of, this specification illustrate one embodiment of the invention and together with the description serve to explain the principles of the invention. In the drawings the same reference numerals indicate the same parts.

DESCRIPTION OF THE PREFERRED EMBODIMENT

Figure 1:
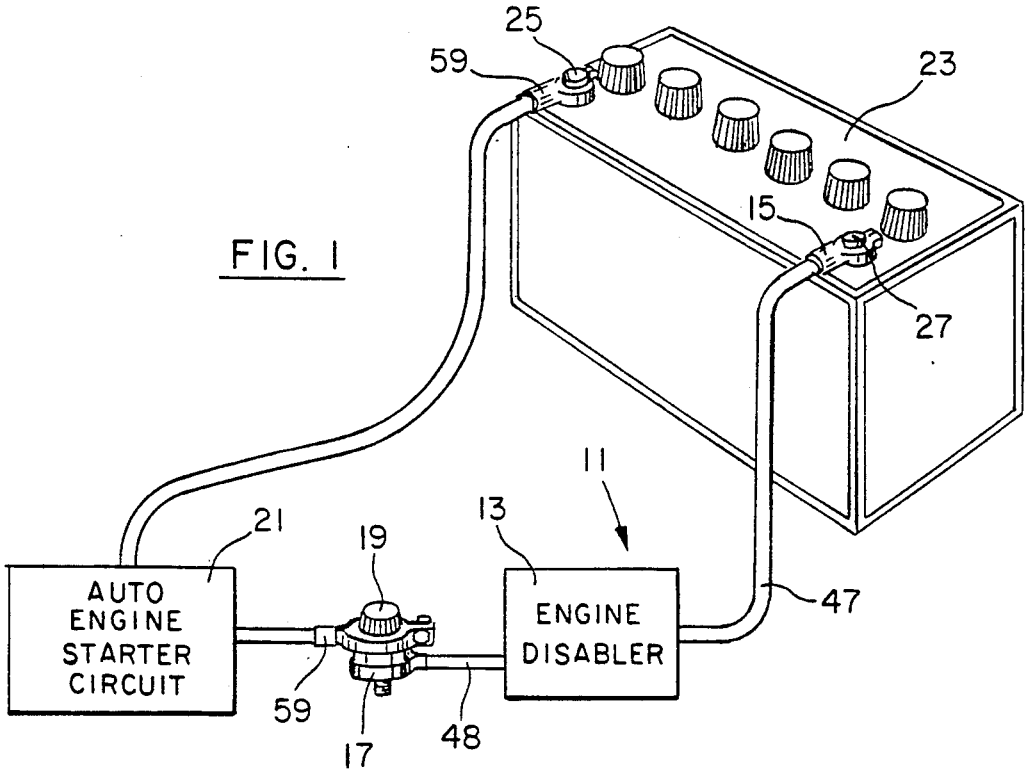
FIG. 1 is a schematic of the kit in accordance with the invention herein connected in an automobile in circuit with an engine starter circuit and with a battery having post terminals.
Figure 2:
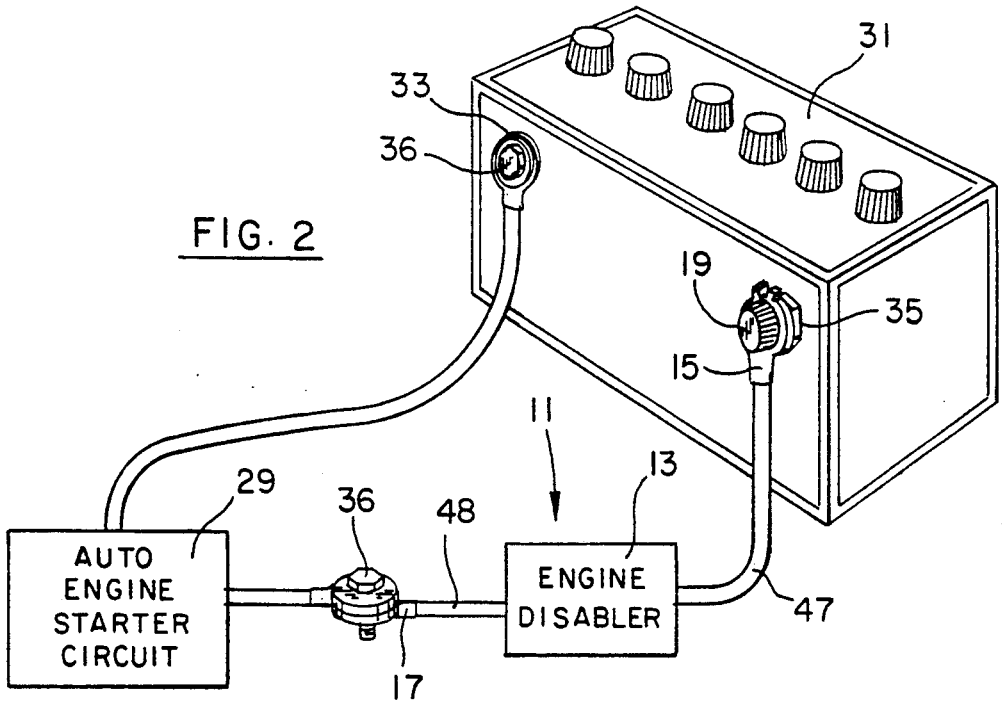
FIG. 2 is a schematic of a kit in accordance with the invention herein in an automobile in circuit with an engine starter circuit and an automobile battery having nut terminals.
Figure 4A:
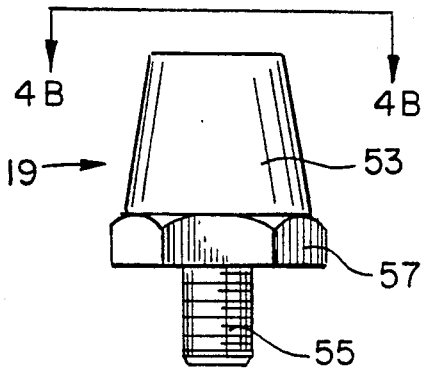
FIG. 4A is a side elevational view of another component (namely, an adaptor post) of the kit shown in FIGS. 1 and 2.
Figure 3:
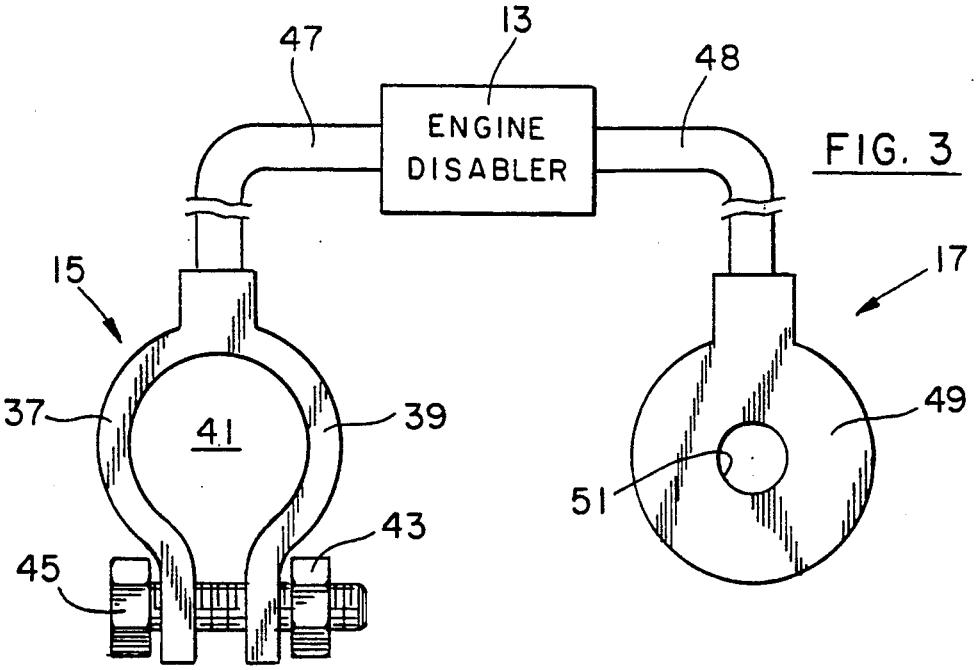
FIG. 3 is a top plan view (partially in schematic) of certain components (namely, an electrical apparatus, clamp connector and nut connector) of the kit shown in FIGS. 1 and 2.
Figure 5:
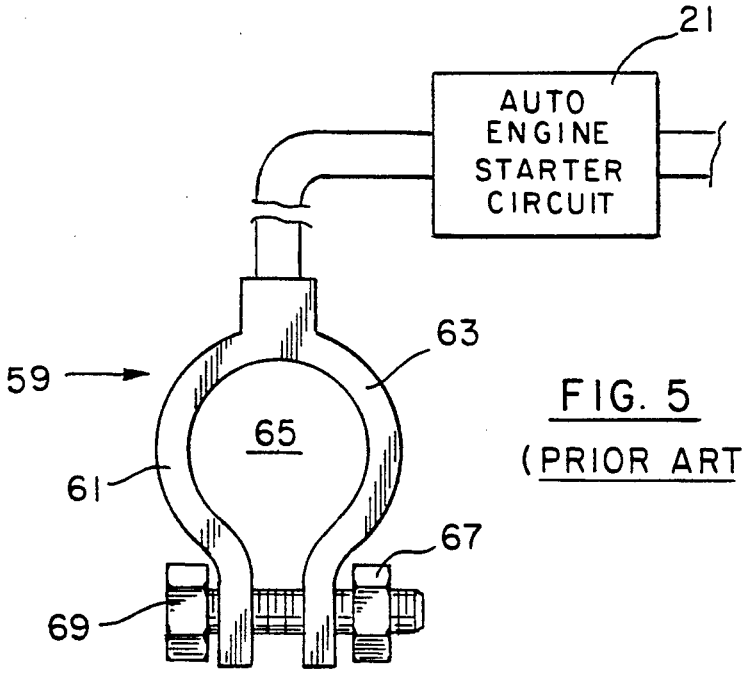
FIG. 5 (PRIOR ART)
FIG. 5 is a top plan view (partially in schematic) of a prior art automobile engine starter circuit with a clamp connector.
Figure 6:
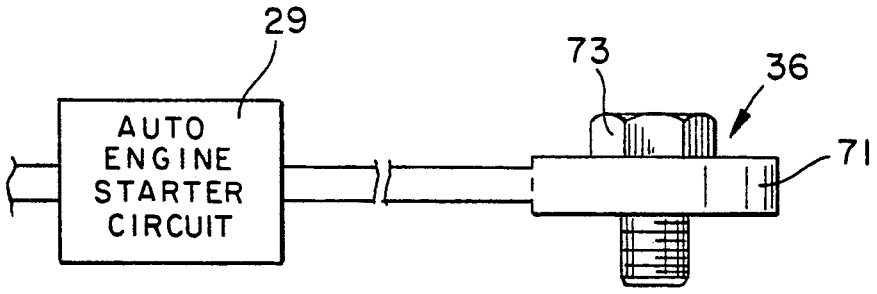
FIG. 6 (PRIOR ART)
FIG. 6 is a side elevational view (partially in schematic) of a prior art automobile engine starter circuit with a screw connector.

The preferred embodiment of a kit for connecting an electrical apparatus in circuit with either an automobile battery having post terminals or an automobile battery having nut terminals is shown in FIGS. 3 and 4A and B. FIGS. 1 and 2 schematically illustrate the kit connected to a battery with post terminals and to a battery with threaded nut terminals, respectively. FIGS. 5 and 6 show a prior art automobile clamp connector and a prior art screw connector, respectively.

Figure 4B:
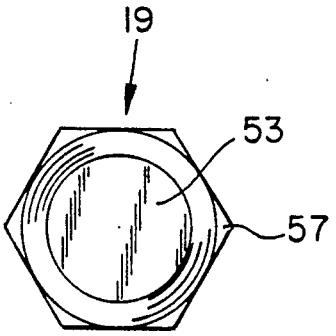
FIG. 4B is a top plan view of the component shown in FIG. 1.

In brief, as shown in FIGS. 3, 4, kit 11 comprises an electrical apparatus 13, a clamp connector 15, a nut connector 17 and an adaptor post 19. Kit 11 enables electrical apparatus 13 to be selectively connected in an automobile in circuit alternatively with an engine starter circuit 21 and a battery 23 having post terminals 25, 27 (FIG. 1) and with an engine starter circuit 29 and an automobile battery 31 having nut terminals 33, 35 (FIG. 2) by appropriate connection of adaptor post 19.

In FIG. 1, adaptor post 19 is connected between a clamp connector 59 of starter circuit 21 and nut connector 17. In FIG. 2, adapter post 19 is connected between clamp connector 15 and nut terminal 35.

In accordance with the invention, kit 11 comprises electrical apparatus 13. As embodied herein, apparatus 13 is preferably an engine disabler component (schematically shown) of an automotive security system (not shown). In the automotive security system, the disabler disables operation of the engine starter circuit responsive to alarm condition and enables operation of the engine starter circuit in the absence of an alarm condition. Alternatively, the electrical apparatus 13 may be constituted by devices such as (a) a battery charger connectable to line voltage for recharging battery 23, 31 and (b) a receptacle for connection to an accessory (e.g., a vacuum or other tool) to be powered by battery 23, 31.

In accordance with the invention, the kit 11 comprises a clamp connector 15 for electrical connection to post terminal 27 of automobile battery 23. Clamp connector 15 is electrically connected to apparatus 13. As embodied herein, clamp connector 15 comprises a pair of jaws 37, 39 defining a generally cylindrical opening 41, a nut 43 and bolt 45. Bolt 45 extends through openings in the distal end of jaws 37, 39. As is well known, jaws 37, 39 may be clamped to a post by tightening nut 45 on bolt 43. Clamp connector 15 may be identical to prior art clamp connectors (FIG. 5) which are used in automobiles for connection to the battery post terminals. Clamp connector 15 is electrically connected to electrical apparatus 13 by a conventional insulated cable 47.

In accordance with the invention, the kit further comprises nut connector 17 for electrical connection to a screw connector 36 electrically connected to the automobile starter circuit 29. Nut connector 17 is electrically connected to electrical apparatus 13. As embodied herein, nut connector 17 comprises a disc shaped nut 49 having a cylindrical threaded opening 51 for receiving screw connector 36. Connector 17 is electrically connected to apparatus 13 by a cable 48. Nut connector 17 may further comprise a suitable rubber or plastic insulating housing (not shown).

Kit 11 may further comprise adaptor post 19 which has a clampable segment 53 at one end, a screw segment 55 at the second end and an intermediate hexagonal segment 57 for engagement with a wrench (not shown). Clampable segment 53 is clampable alternatively in a conventional automotive clamp connector 59 (FIG. 5) and in clamp connector 15 connected to electrical apparatus 13 as depicted in FIG. 1. Screw segment 55 is alternatively threadable in the nut 49 of nut connector 17 (FIG. 1) and in nut terminal 35 (FIG. 2) of battery 31.

In FIG. 5, prior art clamp connector 59 is illustrated in more detail. Clamp connector 59 is illustrative of the type of clamp connector which is used in automobiles equipped with batteries having post terminals to connect the automobile engine starter circuit to each post terminal of the battery. Clamp connector 59 comprises a pair of jaws 61, 63 defining a generally cylindrical opening 65; nut 67 and bolt 69. As is well known, jaws 61, 63 may be clamped to a post terminal by tightening nut 67 on bolt 69.

In FIG. 6, prior art screw connector 36 is illustrated in more detail. Screw connector 36 is illustrative of the type of connector which is used in automobiles equipped with a battery having nut terminals to connect the automobile engine starter circuit to each nut terminal of the battery. Screw connector 36 comprises a disc 71 having a central opening and a bolt 73 captured by and rotatable in the disc opening.

In use as depicted in FIGS. 1, 2, kit 11 may be interchangeably connected in circuit with engine starter circuit 21 and battery 23 with post terminals 25, 27 and in circuit with starter circuit 29 and battery 31 with nut terminals 33, 35. As shown in FIG. 1, to connect electrical apparatus 13 to battery 23, clamp connector 15 is clamped to post terminal 27. Then post segment 55 is threaded into opening 51 of nut connector 17. Lastly, automobile clamp connector 59 is clamped to post segment 53 to complete the connection of electrical apparatus 13 in series with the engine starter circuit 21 and battery 23.

As depicted in FIG. 2, electrical apparatus 13 is connectable in circuit with automobile starter circuit 29 and battery 31 having nut terminals 33, 35 by screwing post segment 55 into nut terminal 35 and clamping clamp connector 15 onto post segment 53. Then, screw connector 36 is threaded into nut connector 17 to complete the electrical connection of electrical apparatus 13 in circuit with circuit 29 and battery 31.

As will be appreciated, kit 11 provides a simple, low cost means for electrically connecting apparatus 13 alternatively in automobiles equipped with standard batteries having post terminals and in automobiles equipped with standard batteries having nut terminals by connecting a nut connector 17 and a clamp connector 15 to apparatus 13 and then by connecting adaptor post 19 in the location shown in FIG. 1 or FIG. 2. Thus, in the preferred embodiment, only three components (clamp connector 15, nut connector 17 and adaptor post 19) are required for connection of apparatus 13 to any standard battery.

It will be apparent to those skilled in the art that various modifications and variations can be made in the kit of the present invention without departing from the scope or spirit of the invention. Thus, it is intended that the present invention cover these modifications and variations provided they come within scope of the appended claims and their equivalents.

We claim:

1. A device for connection in an automobile in circuit alternatively (a) in a first assembly with (1) a first engine starter circuit having an automobile clamp connector and (2) a first automobile battery having post terminals and (b) in a second assembly with (1) a second engine starter having automobile screw connectors and (2) a second automobile battery having nut terminals comprising:

an electrical apparatus having a clamp connector at one end and a nut connector at the other end;

an adaptor post having a clampable segment at one end and a screw segment at the second end;

said clamp connector for electrical connection in the first assembly to one post terminal of the automobile battery and in the second assembly to the clampable segment of the adaptor post, said clamp connector electrically connected to the apparatus; and said nut connector for electrical connection in the first assembly to the screw segment of the adaptor post and in the second assembly to one screw connector electrically connected to the second automobile starter circuit, the nut connector electrically connected to the apparatus.

2. The device of claim 1 wherein the clamp connector has pair of jaws defining a generally cylindrical opening for receiving the post terminal.

3. The device of claim 1 wherein the nut connector comprises a nut having a cylindrical threaded opening for receiving the screw connector.

4. The device of claim 1 wherein the clampable segment of the adaptor post is clamped in the clamp connector.

5. The device of claim 4 wherein the nut connector comprises a nut and the screw segment is threaded in the nut of the nut connector.

6. An engine disabler kit for connection in an automobile in circuit with an engine starter circuit and with alternatively an automobile battery having post terminals and an automobile battery having nut terminals comprising:

an engine disabler;

an adaptor post comprising a screw segment and a clampable segment;

a clamp connector for electrical connection alternatively to a post terminal of an automobile battery and to the clampable segment of the adaptor post, said clamp connector electrically connected to the engine disabler; and a nut connector for electrical connection alternatively to a screw connector electrically connected to the automobile starter circuit and to the screw segment of the adaptor post, the nut connector electrically connected to the engine disabler.

7. The kit of claim 6 wherein the clampable segment of the adaptor post is clamped in the clamp connector.

8. The kit of claim 6 wherein the screw segment is threaded in the nut of the nut connector.

* * * * *